US010663227B2

(12) United States Patent
Neumann Roeschmann

(10) Patent No.: US 10,663,227 B2
(45) Date of Patent: May 26, 2020

(54) VENTILATION ASSEMBLY

(71) Applicant: NEUMANN S.A., Talcahuano (CL)

(72) Inventor: Rodolfo Jorge Neumann Roeschmann, G Concepcion (CL)

(73) Assignee: NEUMANN S.A., Talcahuano (CL)

( * ) Notice: Subject to any disclaimer, the term of this patent is extended or adjusted under 35 U.S.C. 154(b) by 107 days.

(21) Appl. No.: 15/771,669

(22) PCT Filed: Oct. 19, 2016

(86) PCT No.: PCT/IB2016/056291

§ 371 (c)(1),
(2) Date: Apr. 27, 2018

(87) PCT Pub. No.: WO2017/072631

PCT Pub. Date: May 4, 2017

(65) Prior Publication Data

US 2018/0306504 A1 Oct. 25, 2018

(30) Foreign Application Priority Data

Oct. 28, 2015 (CL) ..... 3170-2015

(51) Int. Cl.

| | |
|---|---|
| ***F26B 5/04*** | (2006.01) |
| ***F26B 21/02*** | (2006.01) |
| ***F26B 21/00*** | (2006.01) |

(52) U.S. Cl.
CPC ..... *F26B 21/02* (2013.01); *F26B 21/004* (2013.01)

(58) Field of Classification Search
CPC ..... F26B 21/02; F26B 21/004
USPC ..... 34/417, 307, 311, 201, 202, 242, 667
See application file for complete search history.

(56) References Cited

U.S. PATENT DOCUMENTS

2014/0367967 A1* 12/2014 Ossyra ..... F03D 7/0248 290/44

* cited by examiner

*Primary Examiner* — John P McCormack
(74) *Attorney, Agent, or Firm* — Hoglund & Pamias, PSC; Roberto J. Rios

(57) ABSTRACT

A ventilation assembly is defined comprising a fan located in the top of a drying chamber or furnace and which recirculates gases at high temperatures and/or humidity; a drive shaft with its mounts or bearings, on which is mounted the fan, and a separation chamber which houses the shaft bearings and separates said bearings from the inside of the drying chamber or furnace. The separation chamber is open to the external environment and is sized such that a person may enter it to perform maintenance of the shaft bearings without the need to enter the dryer or furnace. The ventilation assembly may further include the pre-assembly in the factory of the engine, its transmission system and/or one or more air renewal vents. Furthermore, the assembly can be complemented with trusses to further facilitate installation on the walls of the dryer or furnace.

8 Claims, 3 Drawing Sheets

VENTILATION ASSEMBLY

Multiple methods have been used to move the fans inside dryers and furnaces. More than 50 years ago it was common to use one longitudinal shaft per dryer, where the fans were joined with buttresses and circulating air in a perpendicular "Z shape" from one plenum to another. After that and until today engines have been used inside the drying chamber directly coupled to the fans with special insulations class H, which supported high temperatures and humidity.

During the last decades it has been sought to lower the costs of drying by accelerating the processes, and this is made by increasing the speed and temperature of the recirculated air. As the power required by the fans increases with the cube of the speed, the trend has been to increase the diameter of the fans and operate them with engines located outside of the chamber. The driving power is transmitted by shafts that enter the chamber through the top of one of its walls and rest over bearings with bearings in the outside and inside of the enclosure, away from the wall to facilitate air circulation. Particularly, the last bearing inside the enclosure needs to be lubricated with a special lubricant that must withstand high humidity and temperatures that can occur inside the enclosure in some phases of the work cycle. This lubricant is very expensive and must be changed periodically. To do this, maintenance personnel must work at high altitude, which is very risky and has even caused deaths; the operation is poorly supervised, is time consuming and lowers the operation factor of the dryer or furnace.

Different examples of ventilation systems having the above problems or disadvantages can be found in the prior art. For example, Chinese patent with publication number 104314847, dated Jan. 28, 2015, describes a ventilation system in which an engine located outside the furnace extends its shaft through the wall to a radial fan located inside the furnace. The US patent US 20080116621, dated May 22, 2008, describes a similar system applicable for thermal processes of ceramics wherein the fan is a radial fan and is located on the roof, however, radial fans are less efficient than axial fans for moving large flows of gas. US patent 20030226277, dated Dec. 11, 2003, describes a system to recirculate air in a more convenient manner in a dryer of wood with an axial fan, but with its engine located within the chamber. U.S. Pat. No. 5,107,607 of Apr. 28, 1992, describes a ventilation system for large wood dryers, wherein an external engine moves two fans that are spaced and coupled by a common shaft. In the catalogs of manufacturers of dryers it is common to find ventilation systems in which the engine and a mount or bearing of the drive shaft of an axial fan are located outside the chamber and the other mount or bearing is supported by an internal structure subjected to the prevailing climate in the chamber, alongside the fan. (See http://www.corma.cl/file/seminarios/documento/rodolfo-neumann.pdf)

As can be seen, the technologies available in the prior art show configurations in which either the engine or one or more shaft bearings are located inside the drying enclosure, thus being exposed to the humidity and temperature conditions thereof. In addition, as a result of these configurations, access to these elements by the staff becomes difficult, either for installation or for maintenance operations, because they are at height and in places of limited space and difficult to access.

To overcome the above problems a ventilation assembly is presented, comprising a separation chamber in communication with the exterior of the drying enclosure, and which can house the engine and the shaft bearings such that they operate out of the environmental conditions inside the enclosure. The chamber has a shape and size that allows the expedited runoff of the recirculated inner gas flow, and that also allows a person to access the bearings and perform maintenance operations from the outside of the enclosure, without contacting the inside.

Therefore, the proposed ventilation assembly has the following advantages in relation to the systems of the prior art:

All parts requiring maintenance are located outside the dryer, particularly the bearings of the fans, which increases its operation factor, reduces the cost of maintenance, either because of the labor force or because the use of special lubricants requiring to withstand high temperatures and/or humidity can be avoided, and reduces the risk of accidents of individuals, because they no longer have to climb periodically over the false ceilings to change the bearing lubricant.

The fans can be easily installed and balanced at the factory before being dispatched.

The vents are installed and adjusted at the factory.

As the dryers are preassembled the mounting work is reduced and thus its cost.

The reliability of the dryers increases, since the assembly and control at the factory of the most sensitive elements is easier to perform.

The risk for the personnel due to the assembly and maintenance is reduced, as it includes a separation chamber that separates the shaft bearings from the inside of the drying chamber or furnace.

DETAILED DESCRIPTION OF THE INVENTION

Figure 1:
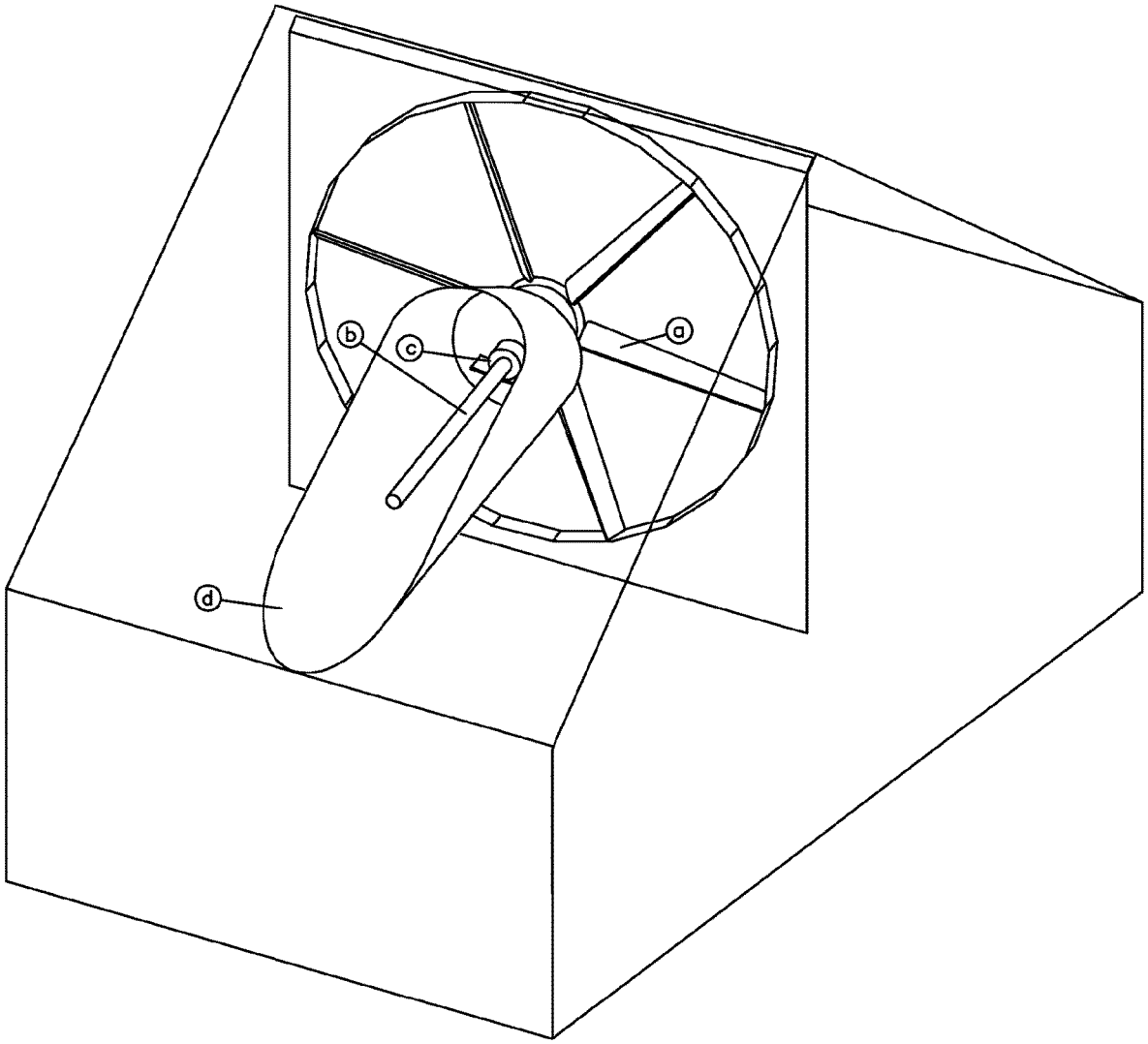
FIG. 1 shows a perspective view of the ventilation assembly of the present invention, wherein the separation chamber is shown with the respective drive shaft and fan.
Figure 2:
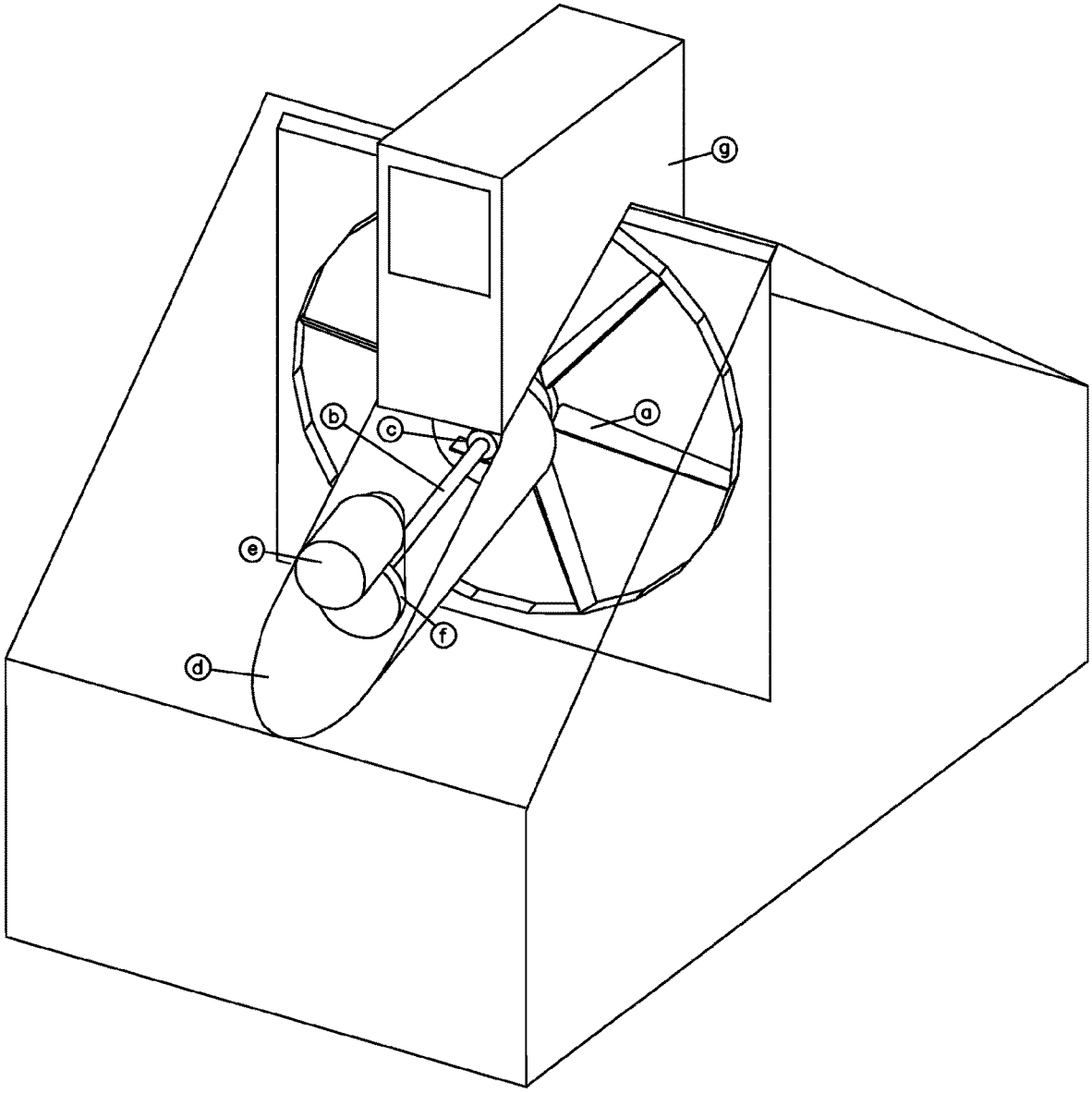
FIG. 2 shows a perspective view of the ventilation assembly of FIG. 1, wherein the engine, transmission assembly, and air renewal vents are shown.
Figure 3:
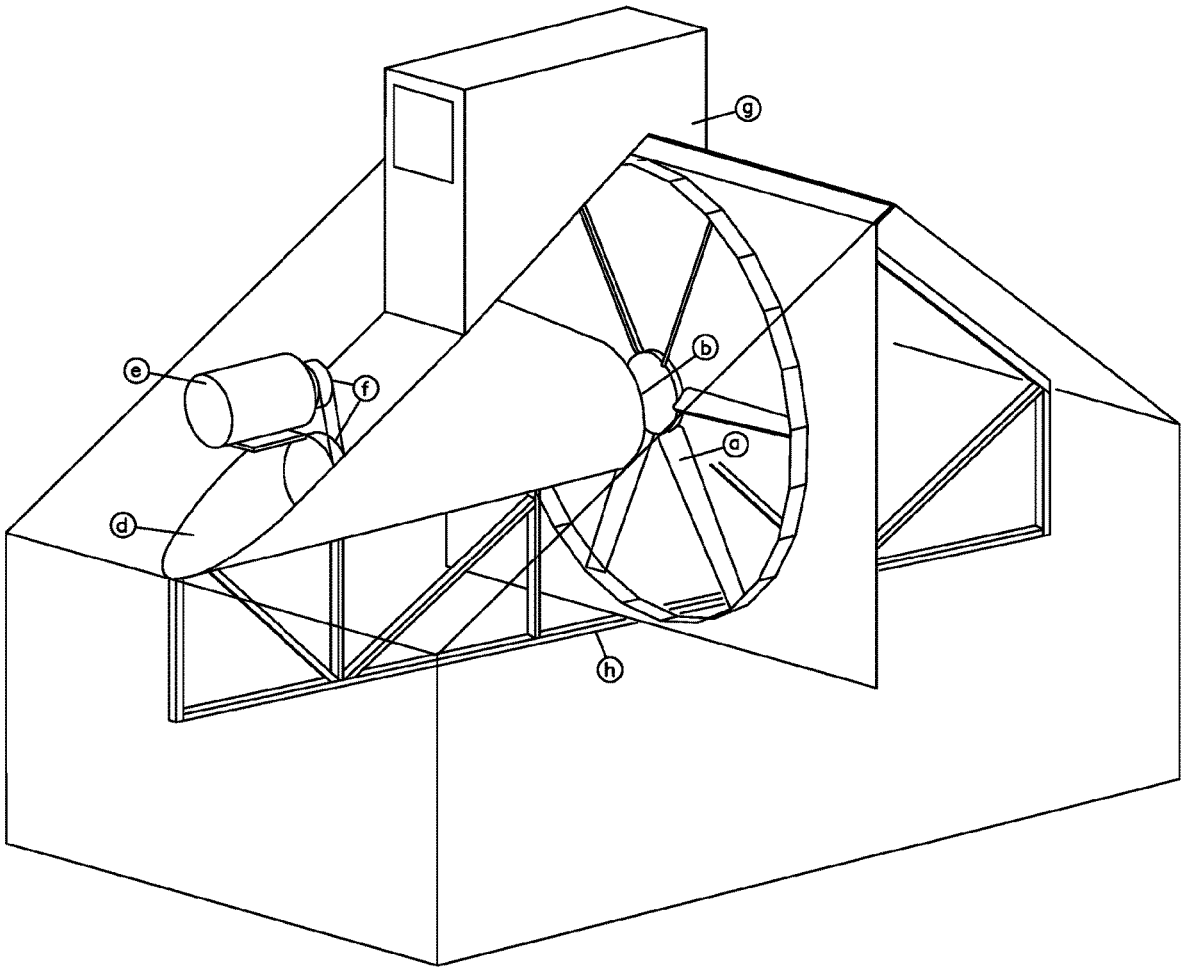
FIG. 3 shows a perspective view of the ventilation assembly of FIG. 2, wherein the assembly is part of a truss.

In the set of claims a ventilation assembly having all the mentioned advantages is described. The basic module shown in FIG. 1 comprises an axial fan (a) located inside an enclosure, furnace and/or closed place, for recirculating humid air, vapor or gas, which is mounted on an shaft (b) and having at least one bearing (c) next to the fan housed and supported in a separation chamber (d). At the bottom and sides the separation chamber insulates the inner enclosure from the external environment and allows the runoff of the air flow recirculated inside. On its upper side the separation chamber is open to the environment outside the drying enclosure, so that the shaft bearing located next to the fan is not subjected to the high temperatures and humidity of the recirculated air within the enclosure.

In large fans it is common that their blades are supported by central bushings having diameters of 350 mm and more. With this, in a flow direction there is a central space which can reach the separation chamber (d) without significantly compromising the runoff of the recirculated air and thus its efficiency. The separation chamber may have various shapes, for example cylindrical, square, pentagonal, hexagonal, etc., or a combination thereof, of constant or increasing traverse section. The important thing is that in the inside of the enclosure the flow is not disturbed significantly and at the other side the chamber has a size such that a person can access the first bearing and perform its maintenance from the outside.

The shaft passes from inside the enclosure to the outside by a hole in the cover of the end of the separation chamber, which preferably have a seal to minimize exfiltrations or infiltrations from the inner enclosure. The engine (e) transmits its power to the shaft through a direct coupling, a system of pulleys and belts (f) or a system of sprockets and chains. Thus, all the bearings of the shaft and the engine and the bearings are located outside the enclosure, thereby allowing a more expeditious maintenance. Additionally, the entire assembly may be fully or partially preassembled in the factory, thereby reducing installation work on site.

On the separation chamber (d) a box (g) can be installed with one or more vents to clear the recirculated air at one or both sides of the fan, thus forming a single structural unit. This unit can also be part of a truss (h) which passes through the enclosure and is supported on opposite walls.

The invention claimed is:

1. A ventilation assembly to be located in a closed or partially closed space, including a dryer, a furnace or other similar enclosure, in which a gas is recirculated for drying, heating, marinate or chemically transform a product, wherein said ventilation assembly comprises an axial fan and a shaft on which is mounted the fan, and wherein the shaft is supported by one or more bearings and is driven by an engine located outside the enclosure, the ventilation assembly further comprising:

a separation chamber that is in communication with the outside of the enclosure and projects towards the interior thereof, the separation chamber housing the shaft and the bearings, and allows to insulate these elements from the environmental conditions within the enclosure;

wherein said separation chamber has an aerodynamic shape that allows an expedited runoff of gas flow recirculated within the enclosure, and that has a size that allows a person to access the bearings and carrying out installation and maintenance operations from outside the enclosure without contacting the inside thereof.

2. The ventilation assembly according to claim 1, wherein the separation chamber is open at its top to allow access of individuals.

3. The ventilation assembly according to claim 1, wherein an enclosure can have several ventilation assemblies.

4. The ventilation assembly according to claim 1, comprising one or more vents located above the separation chamber to renew the interior gases forming a unit that can be preassembled and adjusted in a factory.

5. The ventilation assembly according to claim 1, wherein the ventilation assembly is part of a truss that crosses the enclosure and also allows supporting ceiling panels.

6. The ventilation assembly according to claim 1, wherein the engine is installed within or over the separation chamber, directly coupled to the shaft or above the shaft with a drive system of pulleys and belts, forming a preassembled unit and adjusted in a factory.

7. The ventilation assembly according to claim 1, wherein the separation chamber has extensions to support a service walkway outside the enclosure.

8. The ventilation assembly according to claim 1, wherein the separation chamber is thermally insulated and minimizes heat loss from inside to outside the enclosure.

* * * * *